United States Patent [19]

Campos

[11] 4,296,566

[45] Oct. 27, 1981

[54] ARM OR SHOULDER ATTACHMENT FOR GUNSTOCKS

[76] Inventor: Conrad Campos, P.O. Box 687, Tonopah, Nev. 89049

[21] Appl. No.: 70,420

[22] Filed: Aug. 28, 1979

[51] Int. Cl.[3] ..... F41C 23/00

[52] U.S. Cl. ..... 42/71 R; 42/73

[58] Field of Search ..... 42/73, 72, 71 R

[56] References Cited

U.S. PATENT DOCUMENTS

| | | | |
|---|---|---|---|
| 1,088,362 | 2/1914 | Perkins | 42/73 |
| 1,909,171 | 5/1933 | Coupland | 42/73 |
| 2,787,855 | 4/1957 | Guymon | 42/73 |
| 3,209,481 | 10/1965 | Gilbert | 42/71 R |
| 3,324,588 | 6/1967 | Gilbert | 42/71 R |
| 3,442,042 | 5/1969 | Gilbert | 42/73 |

*Primary Examiner*—Charles T. Jordan

*Attorney, Agent, or Firm*—Kerkam, Stowell, Kondracki & Clarke

[57] ABSTRACT

An arm or shoulder engaging attachment is provided for a gunstock which attachment has a rearwardly projecting element positioned in parallel alignment with gun barrel, and which element is adjustably mounted to the rear of a normal gunstock for movement in a path normal to the longitudinal axis of the gun barrel.

2 Claims, 6 Drawing Figures

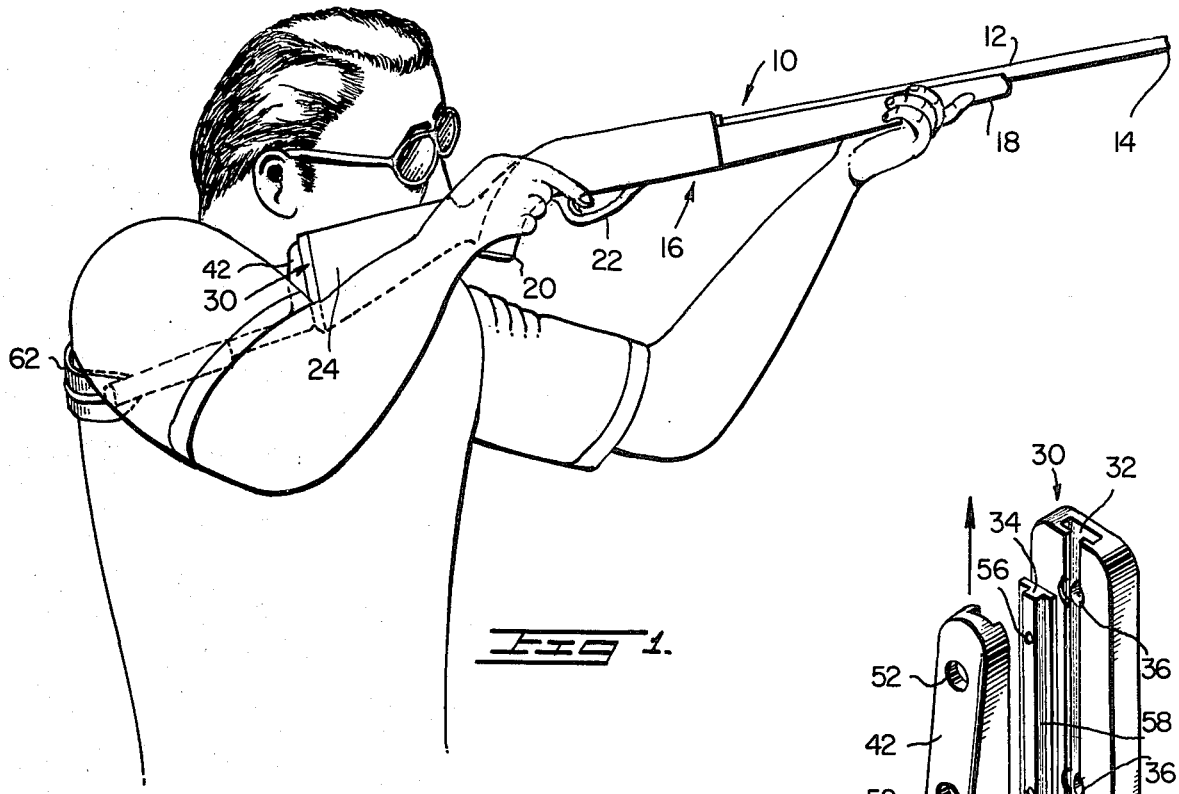
Fig 1.
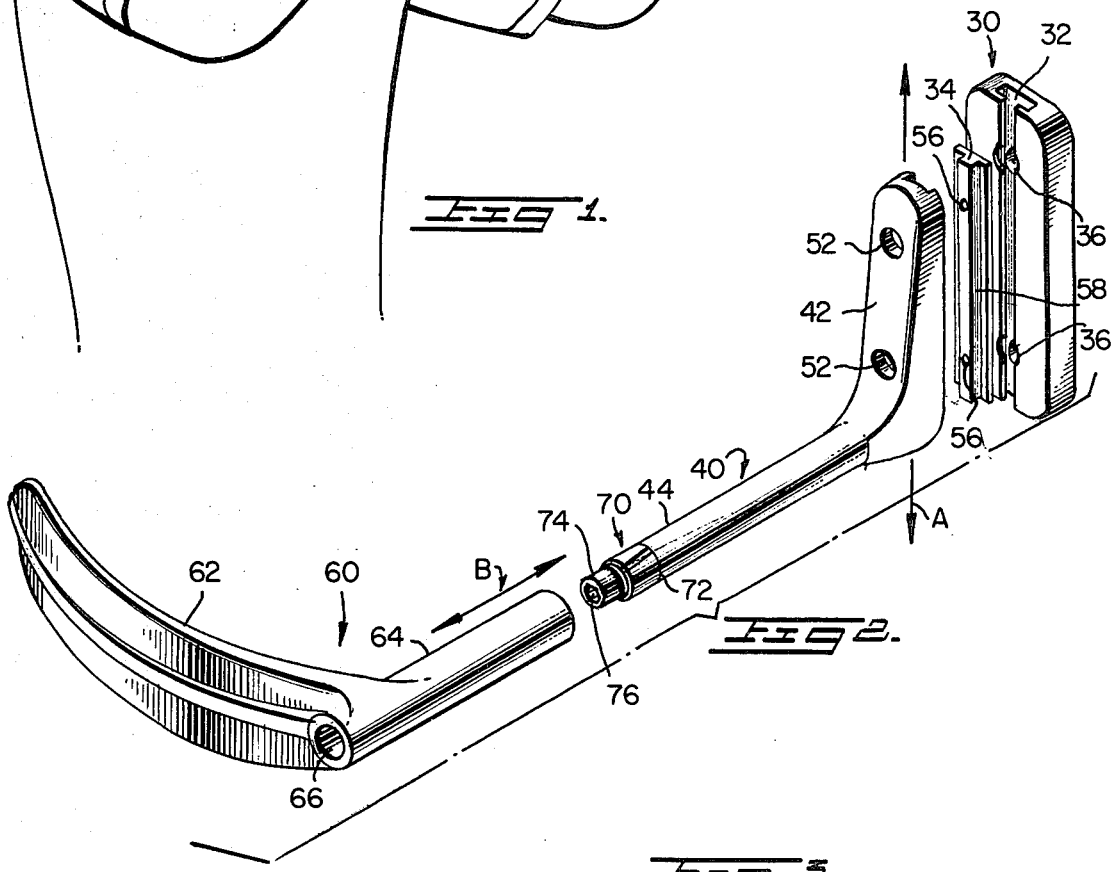
Fig 2.
Fig 3.
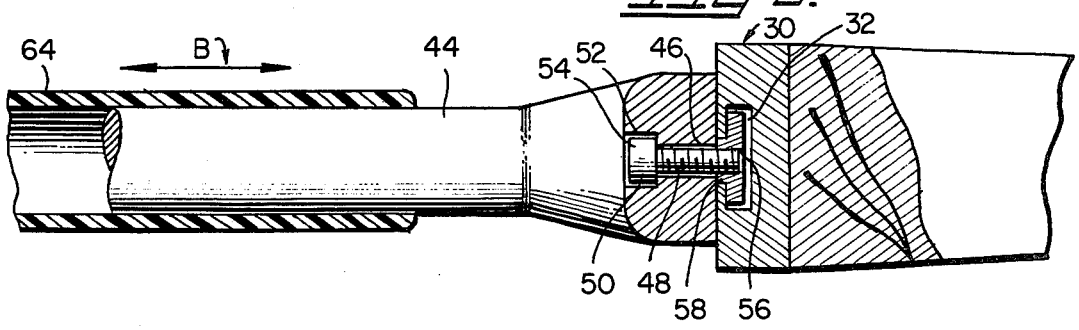

14
18
12
10
16
22
20
24
90°
26
28
60

12
10
24
30
42
44
64
62

26
30
42
44
64
70
74
62

ARM OR SHOULDER ATTACHMENT FOR GUNSTOCKS

DESCRIPTION

1. Technical Field

This invention relates to shoulder or arm engaging attachments for gunstocks of rifles and shotguns.

2. Background of Prior Art

It is known in the art to provide arm or shoulder engaging attachments for rifle and shotgun gunstocks as exemplified by U.S. Pat. Nos. 3,442,042; 3,209,481, and 3,324,588 to William V. T. Gilbert. From this prior art it is known to utilize arms or hooks which extend to the back of the user's arm or shoulder and are adapted to engage the back of the user's arm or shoulder for positioning the weapon for sighting and wherein the recoil impact is absorbed in the palm of the user's hand and in the flexing of the elbow of the user. Because of the toughness of the palm of the hand and the natural tendency of the elbow muscles to flex the recoil impact is absorbed with substantially no injury to the body.

The present invention constitutes an improvement over the gunstocks as previously described but is based upon the same general improvement over the gunstocks of the prior art.

BRIEF SUMMARY OF INVENTION

It is an object of this invention to provide an improved gunstock which includes an arm adapted to engage the back of the user's arm or shoulder, or, if desired, the user's back, that extends rearwardly on an axis parallel to the longitudinal axis of the gun barrel and the arm or shoulder engaging element thereof is rotatable, telescopic and movable in a plane normal to the longitudinal axis of the barrel.

The invention may be defined as a combination consisting of a firearm having a barrel and a rearwardly extending gunstock when the firearm is in the firing position; a stock attachment comprising a butt plate attachable to the butt end of the gunstock; track means formed in the butt plate with the longitudinal axis of the track extending in a vertical direction when the firearm is in the firing position; a first gunstock extending member having a foot portion and a leg portion normal to the foot portion, with track engaging means formed on the foot portion and adapted to engage the track means on the butt plate. Means for releasable securing the track means and track engaging means to each other. A second gunstock extending member comprising a body engaging arm member and rod member. The rod member telescopically engaging the leg member of the first gunstock extending member, and means for securing the rod member to the leg member.

BRIEF DESCRIPTION OF DRAWINGS

FIG. 1 is a perspective view of the present invention applied to a rifle and employed by a marksman;

FIG. 2 is an exploded perspective of the components comprising the present invention;

FIG. 3 is an enlarged fragmentary cross-sectional view of the invention as applied to the butt end of the gunstock of a rifle;

DETAILED DESCRIPTION OF INVENTION

Figures 4, 5, 6:
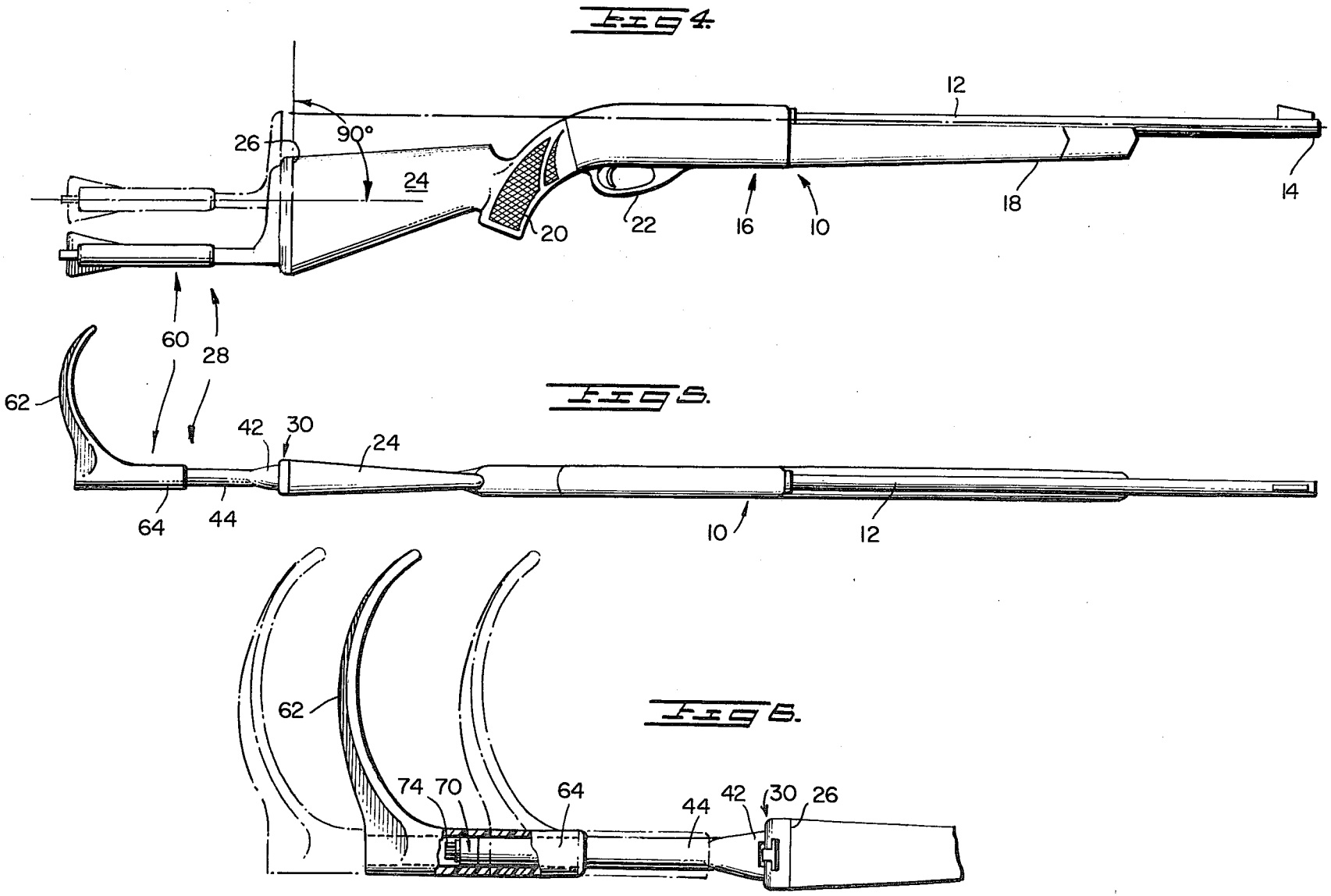
FIG. 4 is a side elevational view of the present invention applied to a rifle and more particularly showing the parallel alignment of the attachment of the invention and the barrel of a rifle.
FIG. 5 is a top plan view of FIG. 4.
FIG. 6 is an enlarged fragmentary top plan view partially broken away, of the invention as applied to the butt end of the gunstock of a rifle.

Referring to the drawing, the firearm illustrated is a rifle 10, having a barrel 12 provided with a muzzle 14 and a gunstock 16. The gunstock 16 includes a portion 18 underlining the barrel 12, a pistol grip 20, a trigger guard 22 and a cheek-engaging portion 24. The rearward end of the gunstock 16 terminates in a butt portion designated 26.

The elements hereinbefore described are conventional rifle or shotgun components which are combined with the novel rearwardly extending gunstock attachment of the present invention generally designated 28.

Referring now more particularly to FIGS. 2 and 3, the novel attachment includes a butt plate 30 provided with a recurved inlet portion 32 which forms a track to engage with a track engaging element 34. The butt plate is provided with bores 36 which receive a pair of screws (not shown) for attachment of the butt plate 30 to the end 26 of the gunstock 16 as illustrated in, for example, FIGS. 3–6.

The assembly 28 further comprises a first gunstock extending member generally designated 40 comprising a foot portion 42 and a leg portion 44, which leg portion is normal to the foot portion. The foot portion 42 is provided with a pair of bores 46, FIG. 3, of a size to freely receive the threaded shank portion 48 of a pair of bolts 50. Each of the bores 46 is counterbored as at 52 to receive the head portion 54 of each of the bolts 50. Corresponding bores 56 are provided in the rib portion 58 of the track engaging member 34 and the bores 56 are internally threaded to receive the threaded shank 48 of the pair of bolts 50.

From the foregoing it will be seen that by loosely attaching the track engaging member 34 to the foot 42 by the pair of bolts 50, the foot and its attached leg 44 may be slid upwardly and downwardly in the direction of the directional arrows A to position the leg 44 at a desired height as illustrated in FIG. 4, and as to be more fully described hereinafter.

The assembly also includes a second gunstock extending member generally designated 60. The second gunstock extending member 60 comprises a body engaging arm member 62 and a hollow rod member 64. The general relationship between parts 62 and 64 are such that they are normal to each other. The bore 66 in the rod portion 64 of the second gunstock extending member 60 is such as to be slidably engagingly over rod portion 44 of the first gunstock extending member 40 as more clearly shown in FIG. 3 of the drawing. In order to secure the sleeve portion 64 of element 60 to the rod 44 of gunstock extending member 40, there is provided a split ring type gripping member generally designated 70 at the extended end 72 of arm 44. The split ring 70 functions in conjunction with a locking bolt 74 having a hexagonal recessed tool receiving opening 76 in its outer end, and the inner end is threaded so that upon rotation of the locking bolt 74 the split locking ring 70 is expanded to tightly grip the internal surface of the bore 66. Tightening and loosening of the locking bolt 74 is carried out by inserting a hex wrench the length of the arm 60 and into engagement in the hex socket 76 as is known in the art.

In addition, the combination of locking ring 70 and locking nut 74 determines the angular relationship between the body engaging portion 62 and the butt end of the stock 24 and/or the butt plate 30.

The following angular relationships should be again considered:

1. The longitudinal axis of the butt plate 30 and its track 32 are normal to the longitudinal axis of the gun barrel 12 as indicated by the 90° arrow in FIG. 4;

2. The foot portion 42 is normal to its associated leg 44 and when locked to the track engaging element 34 in the assembled relationship shown in FIG. 3, the direction of movement of the foot 42 is normal to the longitudinal axis of the barrel 12, thus the longitudinal axis of the leg 44 is always parallel to the longitudinal axis of the barrel 12;

3. The longitudinal axis of the leg portion 64 of the second gunstock extending member 60 is in an axial alignment with the foot portion 44 of element 40, and thus its longitudinal movement in the direction of the directional arrow B, FIGS. 2 and 3, always maintains the second gunstock extending member 60 parallel to the longitudinal axis of the barrel 12.

Raising and lowering the foot portion 42 of element 40 via the butt plate 30 always maintains the hereinabove set forth angular relationships, and such angular relationships are not disturbed by extending or retracting the second gunstock extending member relative to its cooperating first gunstock extending member.

The major function of the vertical movement between the foot portion 42 and the butt plate 30 is to accommodate the attachment for a person differing in weight and/or height substantially regardless of the height and the weight of the person using the firearm the extension always maintains the shooting position of the firearm so that when the leg member 44 and the tubular member 64 are in close contact under the arm of the shooter, the barrel 12 will be parallel with these elements. The heavier or the thicker the arm of the shooter, the lower would be the position of the leg 44 and the tubular element 64 relative to the longitudinal axis of the barrel 12. Similarly, the rotational and telescopic movement of the second gunstock extending member 60 relative to the first gunstock extending member 40 is determined by the weight or fullness of the party using the firearm. As in the prior art, such as the Gilbert U.S. Pat. No. 3,442,042, the firearm is steadied by a forward thrust against the body engaging arm member 62 as illustrated in FIG. 1 of the drawing. Therefore, recoil creates a normal flexure of the elbow of the shooter and reduces substantially to a minimum shock of recoil. While FIG. 1 illustrates the normal shooting arrangement, other shooting arrangements may be accomplished through the use of the present attachment as described in detail in the Gilbert U.S. Pat. No. 3,442,042.

STATEMENT OF INDUSTRIAL APPLICATION

An attachment is provided for firearms which eliminates firearm kick and trigger jerking, which attachment has plural adjustments so that the attachment may be simply adjusted to suit the build of the shooter.

I claim:

1. In combination with a firearm having a barrel and a rearwardly extending gunstock when the firearm is in the firing position, a gunstock attachment comprising:

a butt plate attachable to the butt end of the gunstock;

track means formed in the butt plate with the longitudinal axis of the track extending in a vertical direction when the firearm is in the firing position;

a first gunstock extending member having a foot portion and a leg portion normal to the foot portion;

track engaging means formed on the foot portion and adapted to engage the track means on the butt plate;

means for releasable securing the track means and track engaging means to each other;

a second gunstock extending member comprising a body engaging arm member and a rod member, said rod member telescopically engaging the leg member of the first gunstock extending member;

means for securing said rod member to the leg member, wherein the second gunstock member is rotatable relative to the first gunstock extending member;

wherein the means for securing said rod member to the leg member prevents relative telescopic movement and relative rotational movement between the members; and wherein the securing means for said rod member and the leg member comprise a bolt and split sleeve carried by the extended rearward end of the leg member.

2. The invention defined in claim 1 wherein the body engaging member is contoured to fit the lower shoulder blade of a human being.

* * * * *